US008736523B2

(12) United States Patent
Chung et al.

(10) Patent No.: US 8,736,523 B2
(45) Date of Patent: May 27, 2014

(54) PIXEL CIRCUIT CONFIGURED TO PERFORM INITIALIZATION AND COMPENSATION AT DIFFERENT TIME PERIODS AND ORGANIC ELECTROLUMINESCENT DISPLAY INCLUDING THE SAME

(75) Inventors: Bo-Yong Chung, Yongin (KR); Keum-Nam Kim, Yongin (KR)

(73) Assignee: Samsung Display Co., Ltd., Yongin-si (KR)

( * ) Notice: Subject to any disclaimer, the term of this patent is extended or adjusted under 35 U.S.C. 154(b) by 812 days.

(21) Appl. No.: 12/832,952

(22) Filed: Jul. 8, 2010

(65) Prior Publication Data

US 2011/0084947 A1 Apr. 14, 2011

(30) Foreign Application Priority Data

Oct. 8, 2009 (KR) ..... 10-2009-0095665

(51) Int. Cl.
*G09G 3/30* (2006.01)

(52) U.S. Cl.
USPC ..... 345/76; 345/82

(58) Field of Classification Search
USPC ..... 345/45, 46, 76–86; 315/169.3
See application file for complete search history.

(56) References Cited

U.S. PATENT DOCUMENTS 7,355,572 B2 * 4/2008 Uchino et al. ..... 345/77
7,646,366 B2 * 1/2010 Ha et al. ..... 345/82
2005/0243036 A1 11/2005 Ikeda
2006/0071888 A1 4/2006 Lee et al.
2006/0132055 A1 * 6/2006 Kwak ..... 315/169.3
2006/0231740 A1 * 10/2006 Kasai ..... 250/214.1
2007/0103406 A1 5/2007 Kim
2008/0001861 A1 * 1/2008 Asano et al. ..... 345/77
2008/0036710 A1 * 2/2008 Kim ..... 345/82

(Continued)

FOREIGN PATENT DOCUMENTS

JP 2006-276250 10/2006
KR 10-2006-0012930 2/2006

(Continued)

OTHER PUBLICATIONS

KIPO Notice of Allowance for Korean priority application No. 10-2009-0095665 dated Mar. 23, 2011.

(Continued)

*Primary Examiner* — Chanh Nguyen
*Assistant Examiner* — Sanghyuk Park
(74) *Attorney, Agent, or Firm* — Christie, Parker & Hale, LLP

(57) ABSTRACT

Pixel circuits and an organic electroluminescent display including the same are provided. The pixel circuit includes: an organic light emitting diode; a fifth transistor coupled to a third scan line, a reference power source, and a first node; a first capacitor coupled between the first node and a second node; a second capacitor coupled between the first node and the organic light emitting diode; a fourth transistor coupled to a second scan line, a data line, and the first node; a sixth transistor coupled to a first scan line, a first power source, and the second node; a second transistor coupled to the second scan line, the second node, and a third node; a third transistor coupled to an emission control line, the first power source, and the third node; and a first transistor coupled to the second node, the third node, and the organic light emitting diode.

14 Claims, 5 Drawing Sheets

(56) References Cited

U.S. PATENT DOCUMENTS

| | | | | |
|---|---|---|---|---|
| 2009/0108763 | A1* | 4/2009 | Han et al. | 315/169.3 |
| 2009/0109150 | A1* | 4/2009 | Han et al. | 345/82 |
| 2009/0207105 | A1* | 8/2009 | Hwang et al. | 345/76 |
| 2010/0123700 | A1* | 5/2010 | Kim et al. | 345/211 |
| 2011/0084947 | A1 | 4/2011 | Chung et al. | |

FOREIGN PATENT DOCUMENTS

| | | |
|---|---|---|
| KR | 10-0658618 | 12/2006 |
| KR | 10-2007-0049907 | 5/2007 |
| KR | 10-2008-0113998 | 12/2008 |
| KR | 10-2009-0016333 | 2/2009 |
| KR | 10-2009-0089740 | 8/2009 |

OTHER PUBLICATIONS

KIPO Notice of Allowance dated Jul. 28, 2011, for Korean Patent application 10-2009-0086661, (5 pages).

U.S. Office action dated Nov. 23, 2012, for cross reference U.S. Appl. No. 12/716,151, (17 pages).

U.S. Office action dated Apr. 15, 2013, for cross reference U.S. Appl. No. 12/716,151, (15 pages).

* cited by examiner

① INITIALIZATION PERIOD
② DATA WRITING AND THRESHOLD VOLTAGE COMPENSATION PERIOD
③ DATA PROGRAMMING PERIOD
④ EMISSION PERIOD

① INITIALIZATION PERIOD
② THRESHOLD VOLTAGE COMPENSATION PERIOD
③ DATA WRITING PERIOD
④ EMISSION PERIOD

PIXEL CIRCUIT CONFIGURED TO PERFORM INITIALIZATION AND COMPENSATION AT DIFFERENT TIME PERIODS AND ORGANIC ELECTROLUMINESCENT DISPLAY INCLUDING THE SAME

CROSS-REFERENCE TO RELATED PATENT APPLICATION

This application claims priority to and the benefit of Korean Patent Application No. 10-2009-0095665, filed on Oct. 8, 2009, in the Korean Intellectual Property Office, the disclosure of which is incorporated herein in its entirety by reference.

BACKGROUND

1. Field

One or more embodiments of the present invention relate to a pixel circuit and an organic electroluminescent display including the same.

2. Description of the Related Art

Flat panel displays such as liquid crystal displays (LCDs), plasma display panels (PDPs), field emission displays (FEDs), or organic light emitting displays have been developed to overcome disadvantages of cathode-ray tube (CRT) displays. Among these displays, organic light emitting displays are receiving more attention as a next-generation display due to their high luminescence efficiency, high brightness, wide viewing angles, and short response time.

Organic light emitting displays display images using organic light emitting diodes (OLEDs), which generate light via recombination of electrons and holes. Organic light emitting displays are driven with low power consumption while having a short response time.

SUMMARY

One or more embodiments of the present invention include a pixel circuit in which initialization and compensation are performed during different time periods and an organic electroluminescence display (or organic light emitting display) including the pixel circuit.

Additional aspects will be set forth in part in the description which follows and, in part, will be apparent from the description, or may be learned by practice of the presented embodiments.

According to one or more embodiments of the present invention, a pixel circuit includes: an organic light emitting diode; a fifth NMOS transistor including a gate electrode coupled to a third scan line, a first electrode coupled to a reference power source, and a second electrode coupled to a first node; a first capacitor coupled between the first node and a second node; a second capacitor coupled between the first node and an anode of the organic light emitting diode; a fourth NMOS transistor including a gate electrode coupled to a second scan line, a first electrode coupled to a data line, and a second electrode coupled to the first node; a sixth NMOS transistor including a gate electrode coupled to a first scan line, a first electrode coupled to a first power source, and a second electrode coupled to the second node; a second NMOS transistor including a gate electrode coupled to the second scan line, a first electrode coupled to the second node, and a second electrode coupled to a third node; a third NMOS transistor including a gate electrode coupled to an emission control line, a first electrode coupled to the first power source, and a second electrode coupled to the third node; and a first NMOS transistor for providing a driving current to the organic light emitting diode, the first NMOS transistor including a gate electrode coupled to the second node, a first electrode coupled to the third node, and a second electrode coupled to the anode of the organic light emitting diode.

The pixel circuit may further include a seventh NMOS transistor including a gate electrode coupled to the first scan line, a first electrode coupled to the reference power source, and a second first electrode coupled to the first node.

The seventh NMOS transistor may be configured to transfer a reference voltage from the reference power source to the first node when a first scan signal is transmitted through the first scan line.

The sixth NMOS transistor may be configured to transfer a first voltage from the first power source to the second node when a first scan signal is transmitted through the first scan line.

The fourth NMOS transistor may be configured to transfer a data signal transmitted through the data line to the first node when a second scan signal is transmitted through the second scan line.

The fifth NMOS transistor may be configured to transfer a reference voltage from the reference power source to the first node when a third scan signal is transmitted through the third scan line.

The pixel circuit may be configured to receive the first scan signal, the second scan signal, and the third scan signal sequentially in the stated order.

The first electrode of the first NMOS transistor may be a drain electrode, and the second electrode of the first NMOS transistor may be a source electrode.

According to one or more embodiments of the present invention, a pixel circuit includes: an organic light emitting diode; a fifth NMOS transistor including a gate electrode coupled to a second scan line, a first electrode coupled to a reference power source, and a first electrode coupled to a first node; a first capacitor coupled between the first node and a second node; a second capacitor coupled between the first node and an anode of the organic light emitting diode; a fourth NMOS transistor including a gate electrode coupled to a third scan line, a first electrode coupled to a data line, and a second electrode coupled to the first node; a sixth NMOS transistor including a gate electrode coupled to a first scan line, a first electrode coupled to a first power source, and a second electrode coupled to the second node; a second NMOS transistor including a gate electrode coupled to the second scan line, a first electrode coupled to the second node, and a second electrode coupled to a third node; a third NMOS transistor including a gate electrode coupled to an emission control line, a first electrode coupled to the first power source, and a second electrode coupled to the third node; and a first NMOS transistor for providing a driving current to the organic light emitting diode, the first NMOS transistor including a gate electrode coupled to the second node, a first electrode coupled to the third node, and a second electrode coupled to the anode of the organic light emitting diode.

The pixel circuit may further include a seventh NMOS transistor including a gate electrode coupled to the first scan line, a first electrode coupled to a reference power source, and a second electrode coupled to the first node.

The sixth NMOS transistor may be configured to transfer a first voltage from the first power source to the second node when a first scan signal is transmitted through the first scan line.

The fourth NMOS transistor may be configured to transfer a data signal through the data line to the first node when a third scan signal is transmitted through the third scan line.

The fifth NMOS transistor may be configured to transfer a reference voltage from a reference power source to the first node when a second scan signal is transmitted through the second scan line.

The pixel circuit may be configured to receive the first scan signal, the second scan signal, and the third scan signal sequentially in the stated order.

According to one or more embodiments of the present invention, an organic light emitting display includes: a scan driver for supplying scan signals to scan lines and emission control signals to emission control lines; a data driver for supplying data signals to data lines; and pixel circuits at crossing regions of the scan lines, the emission control lines, and the data lines, wherein at least one of the pixel circuits includes: an organic light emitting diode; a fifth NMOS transistor including a gate electrode coupled to a third scan line of the scan lines, and a first electrode coupled to a first node; a first capacitor coupled between the first node and a second node; a second capacitor coupled between the first node and an anode of the organic light emitting diode; a fourth NMOS transistor including a gate electrode coupled to a second scan line of the scan lines, a first electrode coupled to a data line of the data lines, and a second electrode coupled to the first node; a sixth NMOS transistor including a gate electrode coupled to a first scan line of the scan lines, a first electrode coupled to a first power source, and a second electrode coupled to the second node; a second NMOS transistor including a gate electrode coupled to the second scan line, a first electrode coupled to the second node, and a second electrode coupled to a third node; a third NMOS transistor including a gate electrode coupled to an emission control line of the emission control lines, a first electrode coupled to the first power source, and a second electrode coupled to the third node; and a first NMOS transistor for providing a driving current to the organic light emitting diode, the first NMOS transistor including a gate electrode coupled to the second node, a first electrode coupled to the third node, and a second electrode coupled to the anode of the organic light emitting diode.

The at least one of the pixel circuits may further include a seventh NMOS transistor including a gate electrode coupled to the first scan line, a first electrode coupled a reference power source, and a second electrode coupled to the first node.

The sixth NMOS transistor may be configured to transfer a first voltage from the first power source to the second node when a first scan signal from among the scan signals is transmitted through the first scan line, the fourth NMOS transistor may be configured to transfer a data signal from among the data signals transmitted through the data line to the first node when a second scan signal from among the scan signals is transmitted through the second scan line, the second NMOS transistor may be configured to diode-connect the first NMOS transistor when the second scan signal is transmitted through the second scan line, and the fifth NMOS transistor may be configured to transfer a reference voltage from a reference power source to the first node when a third scan signal from among the scan signals is transmitted through the third scan line.

The scan driver may be configured to sequentially supply the first scan signal, the second scan signal, and the third scan signal to the pixel circuits in the stated order.

According to one or more embodiments of the present invention, an organic light emitting display includes: a scan driver for supplying scan signals to scan lines and emission control signals to emission control lines; a data driver for supplying data signals to data lines; and pixel circuits at crossing regions of the scan lines, the emission control lines, and the data lines, wherein at least one of the pixel circuits includes: an organic light emitting diode; a fifth NMOS transistor including a gate electrode coupled to a second scan line of the scan lines, and a first electrode coupled to a first node; a first capacitor coupled between the first node and a second node; a second capacitor coupled between the first node and an anode of the organic light emitting diode; a fourth NMOS transistor including a gate electrode coupled to a third scan line of the scan lines, a first electrode coupled to a data line of the data lines, and a second electrode coupled to the first node; a sixth NMOS transistor including a gate electrode coupled to a first scan line of the scan lines, a first electrode coupled to a first power source, and a second electrode coupled to the second node; a second NMOS transistor including a gate electrode coupled to the second scan line, a first electrode coupled to the second node, and a second electrode coupled to a third node; a third NMOS transistor including a gate electrode coupled to an emission control line of the emission control lines, a first electrode coupled to the first power source, and a second electrode coupled to the third node; and a first NMOS transistor for providing a driving current to the organic light emitting diode, the first NMOS transistor including a gate electrode coupled to the second node, a first electrode coupled to the third node, and a second electrode coupled to the anode of the organic light emitting diode.

The at least one of the pixel circuits may further include a seventh NMOS transistor including a gate electrode coupled to the first scan line, a first electrode coupled to a reference power source, and a second electrode coupled to the first node.

The sixth NMOS transistor may be configured to transfer a first voltage from the first power source to the second node when a first scan signal from among the scan signals is transmitted through the first scan line, the fourth NMOS transistor may be configured to transfer a data signal from among the data signals transmitted through the data line to the first node when a third scan signal from among the scan signals is transmitted through the third scan line, the second NMOS transistor may be configured to diode-connect the first NMOS transistor when a second scan signal from among the scan signals is transmitted through the second scan line, and the fifth NMOS transistor may be configured to transfer a reference voltage from a reference power source to the first node when the second scan signal is transmitted through the second scan line.

The scan driver may be configured to sequentially supply the first scan signal, the second scan signal, and the third scan signal to the pixel circuits in the stated order.

BRIEF DESCRIPTION OF THE DRAWINGS

The above and other features and aspects of the present invention will become more apparent by describing in detail exemplary embodiments thereof with reference to the attached drawings of which.

DETAILED DESCRIPTION

Figure 1:
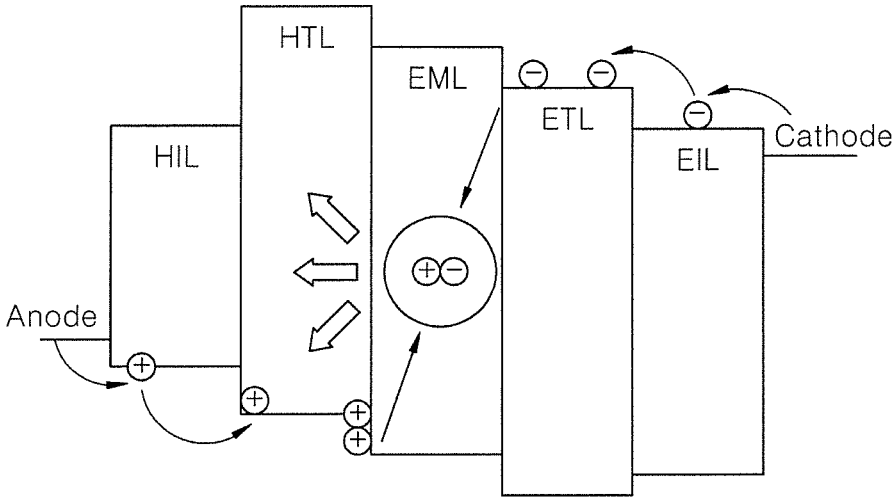
FIG. 1 is a schematic view of an organic light emitting diode.

Reference will now be made in detail to embodiments, examples of which are illustrated in the accompanying drawings, wherein like reference numerals refer to like elements throughout and description about the same or corresponding elements will not be repeatedly presented. In this regard, the present embodiments may have different forms and should not be construed as being limited to the descriptions of embodiments set forth herein. Accordingly, the embodiments are described below, by referring to the figures, to explain aspects of the present invention.

In general, an organic electroluminescent display (e.g., organic light emitting display) is a display device that may emit light by electrically exciting a fluorescent organic compound, and produces an image by voltage-driving or current-driving a plurality of organic light emitting cells arranged in a matrix. Such organic light emitting cells are also referred to as organic light emitting diodes (OLEDs) due to their diode-like characteristics.

FIG. 1 is a schematic view of an OLED.

Referring to FIG. 1, the OLED includes an anode (composed of, e.g., indium tin oxide: ITO), an organic thin film, and a cathode (composed of, e.g., metal). The organic thin film may include, in order to improve luminescence efficiency by maintaining a balance between electrons and holes, an emitting layer (EML), an electron transport layer (ETL), and a hole transport layer (HTL). The organic thin film may further include a hole injecting layer (HIL) and/or an electron injecting layer (EIL).

The organic light emitting cells (of an organic electroluminescent display) may be driven in a passive matrix manner, or in an active matrix manner using a thin film transistor (TFT) or a metal-oxide-semiconductor field-effect transistor (MOSFET). In an organic electroluminescent display driven in to a passive matrix manner, the cathode is formed to be perpendicular to the anode and driving is performed by selecting a line. In an organic electroluminescent display driven in an active matrix manner, a TFT is coupled to an ITO pixel electrode and driving is performed according to a voltage stored in a capacitor coupled to a gate of the TFT. Among various active matrix driving methods, there is a voltage driving method in which a voltage signal is applied to provide a voltage to a capacitor to sustain the voltage therein.

Figure 2:
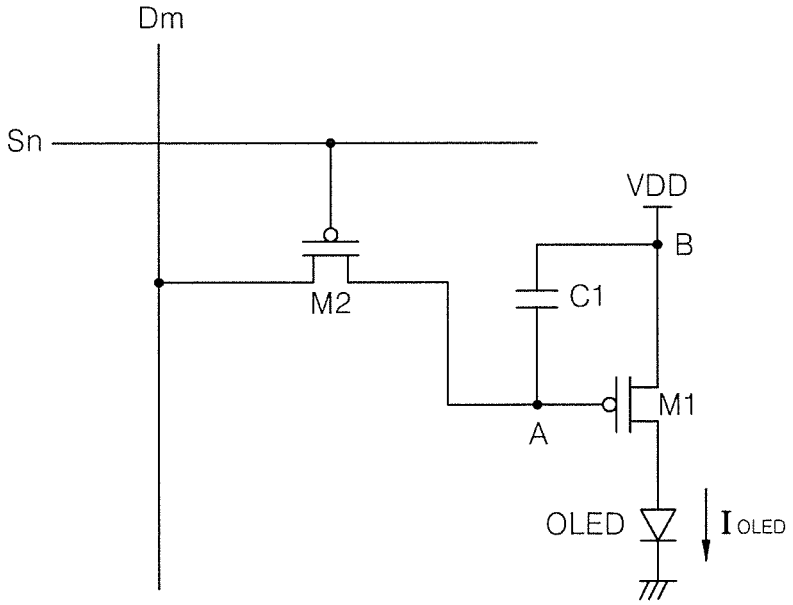
FIG. 2 is a circuit diagram of a pixel circuit driven according to a voltage driving method.

FIG. 2 is a circuit diagram of a pixel circuit driven according to a voltage driving method.

Referring to FIG. 2, a switching transistor M2 is turned on when a selection signal is transmitted through a selected scan line Sn. When the switching transistor M2 is turned on, a data signal transmitted through a data line Dm is transferred to a gate of a driving transistor M1, and a potential difference between the data voltage signal and a voltage source VDD is stored in a capacitor C1 coupled between the gate and a source of the driving transistor M1. Due to the potential difference, a driving current $I_{OLED}$ flows through an OLED and thus the OLED emits light. In this regard, a gray level display (e.g., a predetermined contrast gray level display) is enabled according to the level of the applied data voltage signal.

However, in a plurality of pixel circuits, individual driving transistors M1 may have different threshold voltages. If the driving transistors M1 of pixel circuits have different threshold voltages, the driving transistors M1 may output different amounts of current for a given data voltage signal and thus the image may not have uniform brightness. Such a threshold voltage variation of the driving transistors M1 may increase as the size of an organic electroluminescence display (or organic light emitting display) increases, and accordingly, image quality of the organic electroluminescence display may be adversely affected. Thus, to obtain a more uniform image from an organic electroluminescent light emitting display, the threshold voltage of each of the driving transistors M1 of pixel circuits included in the organic electroluminescent light emitting display may be compensated for.

The threshold voltage of each of the driving transistors M1 of pixel circuits may be compensated for using various application circuits. However, most of these various application circuits concurrently (e.g., simultaneously) perform initialization and compensation for the threshold voltages of the driving transistors M1 for a predetermined amount of time. During initialization, unwanted emission may occur and contrast ratio (C/R) may be degraded. In addition, larger organic electroluminescent displays (or organic light emitting displays) may require longer initialization times, but concurrently performing initialization and compensation for the threshold voltages of the driving transistors M1 may substantially reduce the initialization time compared to smaller organic electroluminescent displays. However, the unwanted emission and contrast ratio degradation may be reduced or prevented by a pixel circuit that drives the initialization and the compensation at separate times.

Figure 3:
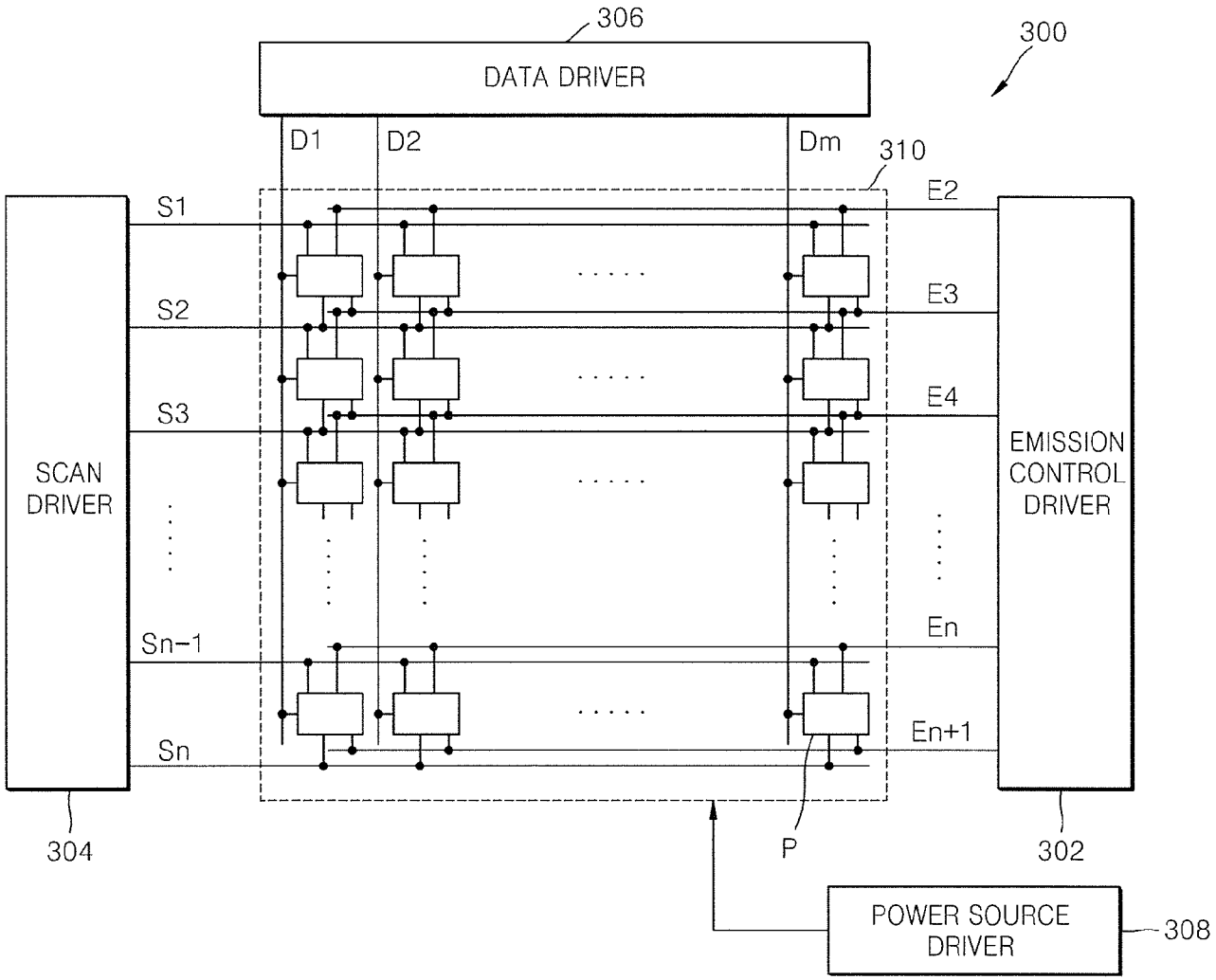
FIG. 3 is a block diagram of an organic electroluminescence display according to an embodiment of the present invention.

FIG. 3 is a block diagram of an organic electroluminescence display (e.g., organic light emitting display) 300 according to one embodiment of the present invention.

Referring to FIG. 3, the organic electroluminescence display 300 according to one embodiment includes a display unit 310, an emission control driver 302, a scan driver 304, a data driver 306, and a power source driver 308.

The display unit 310 may include n×m pixel circuits P each including an OLED (not shown), scan lines S1 through Sn that are aligned (e.g., extending) in rows and for transferring scan signals, data lines D1 through Dm that are aligned (e.g., extending) in columns and for transferring data signals, emission control lines E2 through En+1 that are aligned (e.g., extending) in rows and for transferring emission control signals, and m first power source lines (not shown) and m second power source lines (not shown) for transferring power applied to the pixels.

The display unit 310 may control the OLEDs (e.g., see FIG. 4) to emit light by using scan signals, data signals, emission control signals, and a first voltage from a first power source ELVDD and a second voltage from a second power source ELVSS, in order to display an image.

The emission control driver 302 is coupled to the emission control lines E2 through En+1 and may apply emission control signals to the display unit 310.

The scan driver 304 is coupled to the scan lines S1 through Sn and may apply scan signals to the display unit 310.

The data driver 306 is coupled to the data lines D1 through Dm and may apply data signals to the display unit 310. The data driver 306 may provide the data signals to the pixel circuits P during a programming period.

The power source driver 308 may apply the first voltage from the first power source ELVDD and the second voltage from the second power source ELVSS to each of the pixel circuits P.

Figure 4:
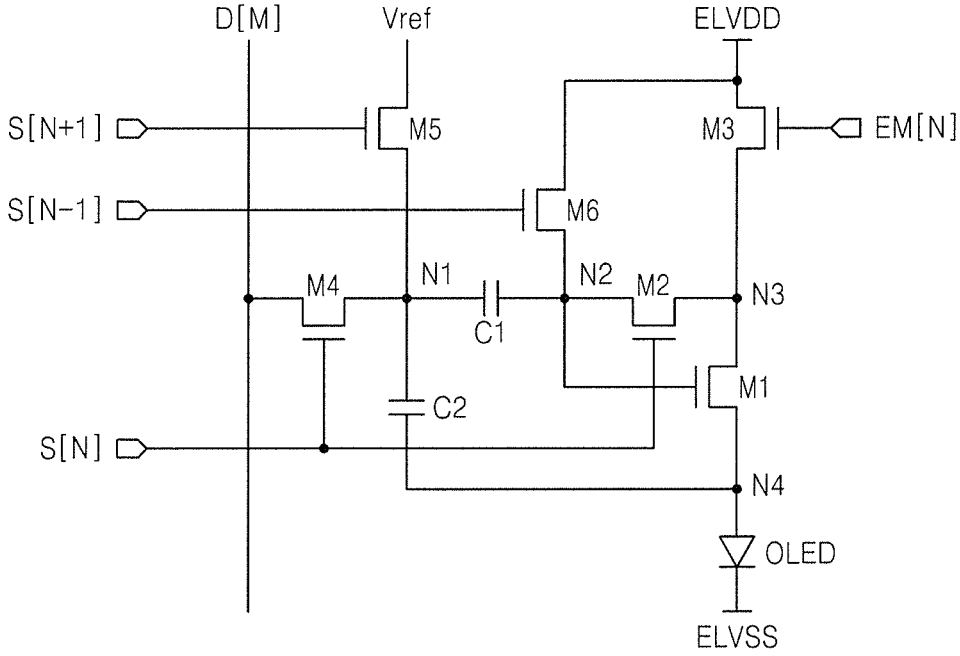
FIG. 4 is a circuit diagram of a pixel circuit illustrated in FIG. 3, according to an embodiment of the present invention.

FIG. 4 is a circuit diagram of a pixel circuit P illustrated in FIG. 3, according to an embodiment of the present invention. For the sake of convenience, FIG. 4 illustrates a pixel circuit that is coupled to a first scan line S[N−1] (e.g., N−1th scan line), a second scan line S[N] (e.g., Nth scan line), a third scan line S[N+1] (e.g., N+1th scan line), an Nth emission control line EM[N], and an Mth data line D[M].

Referring to FIG. 4, with regard to an OLED, an anode of the OLED is commonly coupled to a second capacitor C2 and a source electrode of a first NMOS transistor M1 at a fourth node N4, and a cathode is coupled to a second power source ELVSS. According to the descriptions above, the OLED may generate light having a brightness (e.g., a predetermined brightness) in accordance with a current supplied by a first NMOS transistor M1, which may be a driving transistor.

With regard to a fifth NMOS transistor M5, a gate electrode is coupled to the third scan line S[N+1], a drain electrode is coupled to a reference power source Vref, and a source electrode is coupled to a first node N1. The fifth NMOS transistor M5 is turned on when a third scan signal, that is, a voltage signal having a high level, is transmitted through the third scan line S[N+1], and, when turned on, may transfer a reference voltage from the reference power source Vref to the first node N1.

A first capacitor C1 is coupled between the first node N1 and a second node N2. The second capacitor C2 is coupled between the first node N1 and the anode of the OLED.

With regard to a fourth NMOS transistor M4, a gate electrode is coupled to the second scan line S[N], a drain electrode is coupled to the M data line D[M], and a source electrode is coupled to the first node N1. The fourth NMOS transistor M4 is turned on when a second scan signal, that is, a voltage signal having a high level, is transmitted through the second scan line S[N], and, when turned on, may transfer a data signal to the first node N1.

With regard to a sixth NMOS transistor M6, a gate electrode is coupled to the first scan line S[N−1], a drain electrode is coupled to a first power source ELVDD, and a source electrode is coupled to the second node N2. The sixth NMOS transistor M6 is turned on when a first scan signal, that is, a voltage signal having a high level, is transmitted through the first scan line S[N−1], and, when turned on, may initialize the second node N2 using a first voltage from the first power source ELVDD.

With regard to a second NMOS transistor M2, a gate electrode is coupled to the second scan line S[N], a drain electrode is commonly coupled to the second node N2 together with a gate electrode of the first NMOS transistor M1, and a source electrode is commonly coupled to a third node N3 together with a drain electrode of the first NMOS transistor M1. The second NMOS transistor M2 is turned on when the second scan signal, that is, a voltage signal having a high level, is transmitted through the second scan line S[N], and, when turned on, may short-circuit the gate electrode and drain electrode of the first NMOS transistor M1, thereby diode-connecting the first NMOS transistor M1, that is, a driving transistor.

With regard to a third NMOS transistor M3, a gate electrode is coupled to the Nth emission control line EM[N], a drain electrode is coupled to the first power source ELVDD, and a source electrode is coupled to the third node N3. The third NMOS transistor M3 transfers the first voltage from the first power source ELVDD to the drain electrode of the first NMOS transistor M1 when an emission control signal is transmitted through the emission control line EM[N], that is, a voltage signal having a high level.

With regard to the first NMOS transistor M1, the gate electrode is coupled to the second node N2, the drain electrode is coupled to the third node N3, and the source electrode is commonly coupled to the fourth node N4 together with the anode of the OLED. Thus, the first NMOS transistor M1 may provide a driving current $I_{OLED}$ to the OLED. The driving current $I_{OLED}$ is determined in accordance with a voltage difference Vgs between the gate electrode and the source electrode of the first NMOS transistor M1.

According to an embodiment of the present invention, in the pixel circuit, all the transistors M1 through M6 may be NMOS transistors, wherein the third through sixth NMOS transistors M3 through M6 are switching transistors, the second NMOS transistor M2 is a threshold voltage compensation transistor, and the first NMOS transistor M1 is a driving transistor. An NMOS transistor refers to an N-type metal oxide semiconductor transistor, in which, when a control signal is in a low level state, the NMOS transistor is turned off, and, when the control signal is in a high level state, the NMOS transistor is turned on. An NMOS transistor operates more quickly than a PMOS transistor and thus is useful in a large display.

Figure 5:
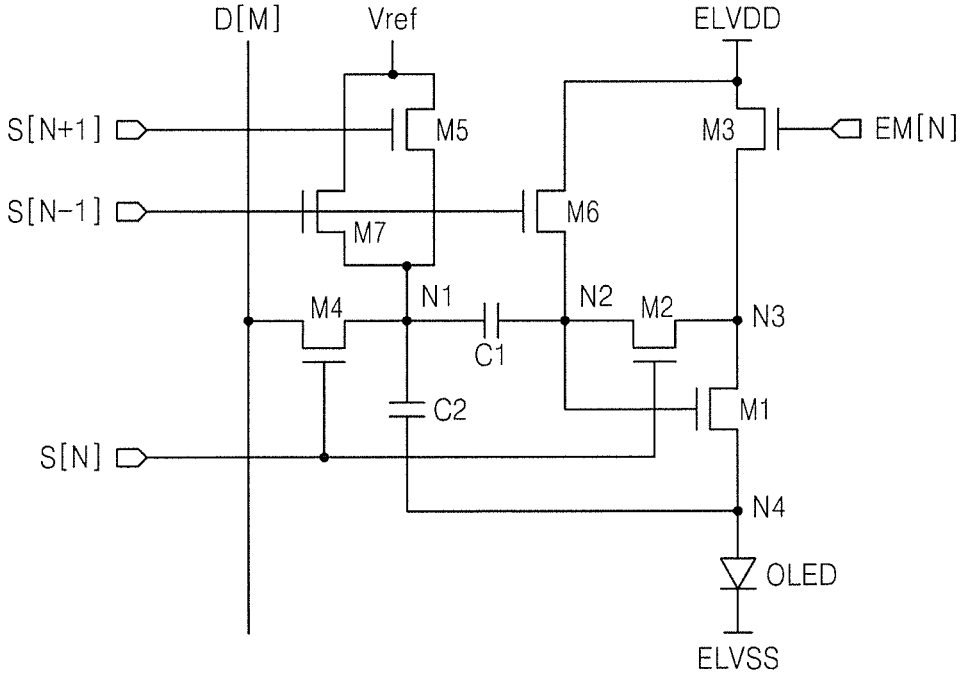
FIG. 5 is a circuit diagram of a pixel circuit illustrated in FIG. 3, according to another embodiment of the present invention.

FIG. 5 is a circuit diagram of a pixel circuit P illustrated in FIG. 3, according to another embodiment of the present invention.

The pixel circuit according to one embodiment depicted in FIG. 5 is different from the pixel circuit of FIG. 4 in that the pixel circuit of FIG. 5 further includes a seventh NMOS transistor M7 that is located in parallel with the fifth NMOS transistor M5.

With regard to the seventh NMOS transistor M7, a gate electrode is coupled to the first scan signal line S[N−1], a drain electrode is coupled to the reference power source Vref, and a source electrode is coupled to the first node N1. The seventh NMOS transistor M7 is turned on when the first scan signal, that is, a voltage signal having a high level, is transmitted through the first scan signal line S[N−1], and, when turned on, may transfer the reference voltage of the reference power source Vref to the first node N1, thereby initializing the first node N1 using the reference voltage from the reference power source Vref.

During an initialization period, in the pixel circuit illustrated in FIG. 4, the second node N2 is initialized using the first voltage from the first power source ELVDD transferred by the sixth NMOS transistor M6, and, in the pixel circuit illustrated in FIG. 5, the second node N2 is initialized using the first voltage from the first power source ELVDD and the first node N1 is initialized using the reference voltage from the reference power source Vref transferred by the seventh NMOS transistor M7.

Driving operations, according to one embodiment of the present invention, of the pixel circuits illustrated in FIGS. 4 and 5 will now be described in detail with reference to the timing diagram shown in FIG. 6.

Figure 6:
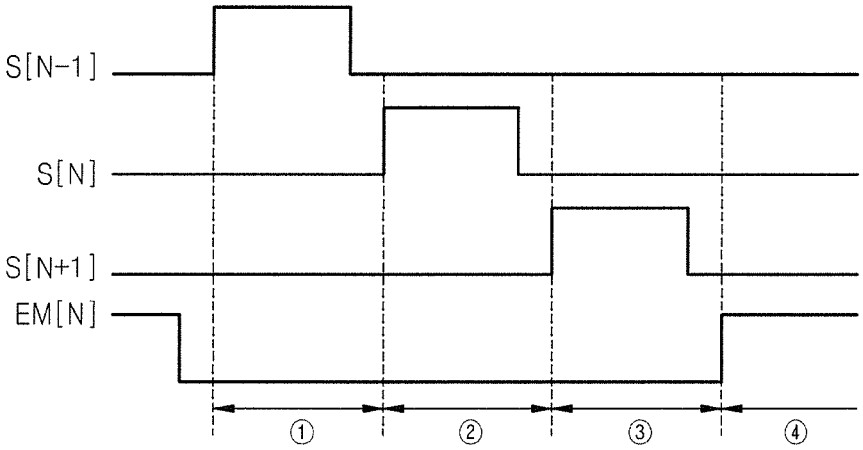
FIG. 6 is a timing diagram of driving signals (or waveforms) which may be used with the pixel circuits illustrated in FIGS. 4 and 5 according to one embodiment of the present invention.

Referring to FIG. 6, a first period is an initialization period during which the first scan signal of the first scan line S[N−1] has a high level. A second period is a data writing and threshold voltage compensation period during which a threshold voltage Vto of the OLED and a threshold voltage Vth of the first NMOS transistor M1, are compensated for and compensated data is written to the first capacitor C1, during which the second scan signal of the second scan line S[N] has a high level. A third period is a data programming period during which the third scan signal of the third scan line S[N+1] has a high level. A fourth period is an emission period during which the emission control signal transmitted through the Nth emission control line EM[N] has a high level.

With reference to FIGS. 4 through 6, switching and driving operations of transistors during the periods will be described in detail.

During the first period, when the first scan signal of the first scan line S[N−1] having a high level is applied, the sixth NMOS transistor M6 is turned on and thus the first voltage from the first power source ELVDD is applied to the second node N2, thereby initializing the first capacitor C1 and the gate electrode of the first NMOS transistor M1. In the pixel circuit illustrated in FIG. 5, when the first scan signal of the first scan line S[N−1] having a high level is applied, the seventh NMOS transistor M7 is turned on together with the sixth NMOS transistor M6 and thus the reference voltage from the reference power source Vref is applied to the first node N1, thereby initializing the second capacitor C2.

During the second period, when the second scan signal having a high level is applied to the second scan line S[N], the fourth NMOS transistor M4 is turned on and thus a data signal Vdata transmitted through the Mth data line D[M] is transferred to the first node N1. In addition, the second NMOS transistor M2 is turned on and thus the second node N2 and the third node N3 are short circuited so that the first NMOS transistor M1, is diode-connected. Thus, the voltage signal applied to the second node N2 is the sum of the threshold voltage Vto of the OLED and the threshold voltage Vth of the first NMOS transistor M1.

During a third period, when the third scan signal having a high level is applied to the third scan line S[N+1], the fifth NMOS transistor M5 is turned on and thus the reference voltage from the reference power source Vref is transferred to the first node N1. Thus, the voltage change at the first node N1 is the absolute value of Vref−Vdata, and the voltage change at the fourth node N4 is the absolute value of Voled−Vto. In this regard, Voled refers to a voltage between ends of the OLED. Thus, the voltage of the second node N2 is Vto+Vth+Vref−Vdata+Voled−Vto and thus Vth+Vref−Vdata+Voled, assuming that the second power source ELVSS is grounded.

During a fourth period, the emission control signal having a high level is applied to the Nth emission control line EM[N], the third NMOS transistor M3 is turned on and thus the first voltage from the first power source ELVDD may be applied to the first NMOS transistor M1. The current $I_{OLED}$ flowing through the OLED is determined according to the following equation:

$$I_{OLED}=K(V_{gs}-V_{th})^2 \quad \text{Equation 1}$$

where K is a constant determined by mobility and parasitic capacitance of a driving transistor, Vgs is the voltage difference between gate and source electrodes of the driving transistor, and Vth is the threshold voltage of the driving transistor. In the present embodiment, Vgs is the voltage difference between the second node N2 and the fourth node N4, that is, the voltage difference between the gate electrode and source electrode of the first NMOS transistor M1.

When Vgs is substituted for in Equation 1, Equation 2 is obtained as follows:

$$I_{OLED}=K(V_{th}+V_{ref}-V_{data}-V_{th})^2$$

$$I_{OLED}=K(V_{ref}-V_{data})^2 \quad \text{Equation 2}$$

By referring to Equation 2, it is identified that the current $I_{OLED}$ flowing through an OLED is determined according to the reference voltage from the reference power source Vref and the data signal Vdata. That is, flow of the current $I_{OLED}$ is not related to the threshold voltage Vth of the first NMOS transistor M1, which is a driving translator, nor is it related to the threshold voltage of the OLED or the voltage of the second power source ELVSS of the OLED.

Thus, since a pixel circuit according to an embodiment of the present invention compensates for the threshold voltage of a driving transistor and is not sensitive to scattering (or variations) of the first and second power sources, the uniformity of the brightness of an image may be improved.

In addition, unlike one conventional pixel circuit, in which initialization and compensation for the threshold voltage of a driving transistor are concurrently performed during a first period, a pixel circuit according to an embodiment of the present invention is driven in such a way that during a first period, initialization is performed, and then, during a second period, data writing and compensation for the threshold voltages of an organic light emitting diode and a driving transistor are performed. Thus, incomplete initialization in some pixel circuits, which may occur due to an organic electroluminescence display being large and a large load caused by high-speed operation, is reduced or prevented. In addition, unlike one conventional OLED, in which a current flows during initialization, according to aspects of the present invention, a current does not flow through an OLED during initialization because initialization is performed using an additional transistor, and thus the OLED does not emit light during initialization, and thus improving a contrast ratio. In addition, use of an emission control driver to transmit an emission control signal enables duty control which may reduce or remove motion blur and reduce or overcome cross-talk.

Figure 7:
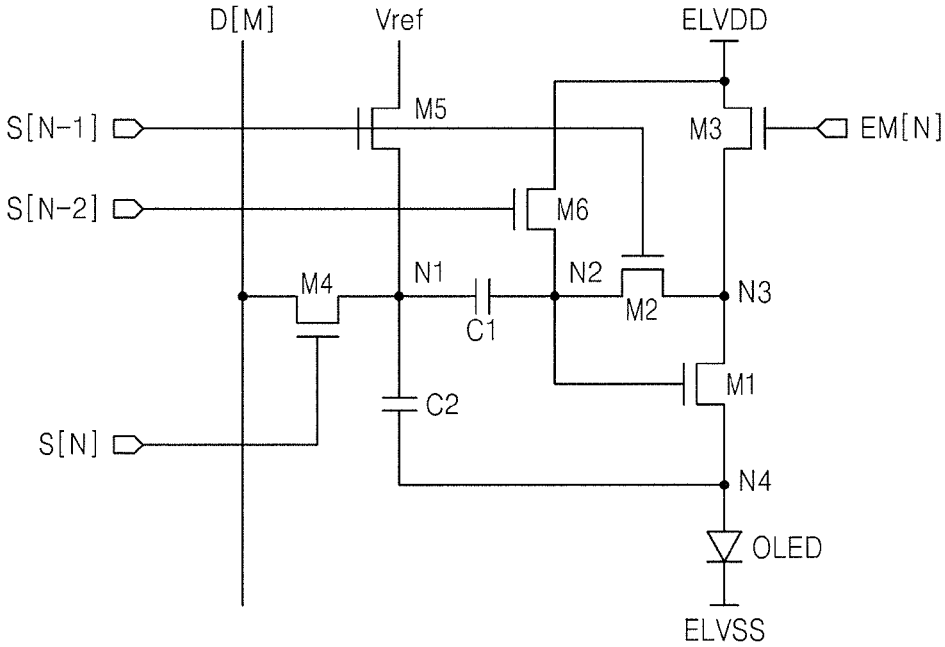
FIG. 7 is a circuit diagram of a pixel circuit illustrated in FIG. 3, according to another embodiment of the present invention.

FIG. 7 is a circuit diagram of a pixel circuit P illustrated in FIG. 3, according to another embodiment of the present invention.

Referring to FIG. 7, with regard to an OLED, an anode of the OLED is commonly coupled to a second capacitor C2 and a source electrode of a first NMOS transistor M1, and a cathode of the OLED is coupled to a second power source ELVSS. According to the descriptions above, the OLED may generate light having a brightness (e.g., a predetermined brightness) corresponding to a current supplied by the first NMOS transistor M1, which may be a driving transistor.

With regard to a fifth NMOS transistor M5, a gate electrode is coupled to a second scan line S[N−1], a drain electrode is coupled to a reference power source Vref, and a source electrode is coupled to a first node N1. The fifth NMOS transistor M5 is turned on when a second scan signal, that is, a voltage signal having a high level, is transmitted through the second scan line S[N−1], and, when turned on, may transfer a reference voltage from the reference power source Vref to the first node N1.

A first capacitor C1 is coupled between the first node N1 and a second node N2. The second capacitor C2 is coupled between the first node N1 and the anode of the OLED.

With regard to a fourth NMOS transistor M4, a gate electrode is coupled to a third scan line S[N], a drain electrode is coupled to a data line D[M], and a source electrode is coupled to the first node N1. The fourth NMOS transistor M4 is turned on when a third scan signal, that is, a voltage signal having a high level, is transmitted through the third scan line S[N], and, when turned on, may transfer a data signal to the first node N1.

With regard to a sixth NMOS transistor, a gate electrode is coupled to a first scan line S[N−2], a drain electrode is coupled to a first power source ELVDD, and a source electrode is coupled to the second node N2. The sixth NMOS transistor M6 is turned on when a first scan signal, that is, a voltage signal having a high level, is transmitted through the first scan line S[N−2], and, when turned on, may initialize the second node N2 using a first voltage from the first power source ELVDD.

With regard to a second NMOS transistor M2, a gate electrode is coupled to the second scan line S[N−1], a drain electrode is commonly coupled to the second node N2 together with a gate electrode of the first NMOS transistor M1, and a source electrode is commonly coupled to a third node N3 together with a drain electrode of the first NMOS transistor M1. The second NMOS transistor M2 is turned on when the second scan signal, that is, a voltage signal having a high level, is transmitted through the second scan line S[N−1], and, when turned on, may short-circuit the gate electrode and drain electrode of the first NMOS transistor, thereby diode-connecting the first NMOS transistor M1.

With regard to a third NMOS transistor M3, a gate electrode is coupled to the Nth emission control line EM[N], a drain electrode is coupled to the first power source ELVDD, and a source electrode is coupled to the third node N3. The third NMOS transistor M3 transfers the first voltage from the first power source ELVDD to the drain electrode of the first NMOS transistor M1 when an emission control signal,is transmitted through the Nth emission control line EM[N], that is, a voltage signal having a high level.

With regard to the first NMOS transistor M1, the gate electrode is coupled to the second node N2, the drain electrode is coupled to the third node N3, and the source electrode is commonly coupled to a fourth node N4 together with the anode of the OLED. Thus, the first NMOS transistor M1 may provide a driving current $I_{OLED}$ to the OLED. The driving current $I_{OLED}$ is determined according to a voltage difference Vgs between the gate electrode and the source electrode of the first NMOS transistor M1.

The pixel circuit according to the present embodiment is different from the pixel circuit illustrated in FIG. 4 in that the second NMOS transistor M2 is coupled to the second scan line S[N−1], and the fourth NMOS transistor M4 is coupled to the third scan line S[N]. Thus, when the second scan signal having a high level is transmitted through the second scan line S[N−1], turning on the second NMOS transistor M2, the first NMOS transistor M1, is diode-connected and thus a threshold voltage Vto of the OLED and a threshold voltage Vth of the driving transistor M1 are compensated for at the second node N2. Then, by applying the third scan signal having a high level through the third scan line S[N], a data signal Vdata is applied to the first node N1, thereby performing data writing.

Figure 8:
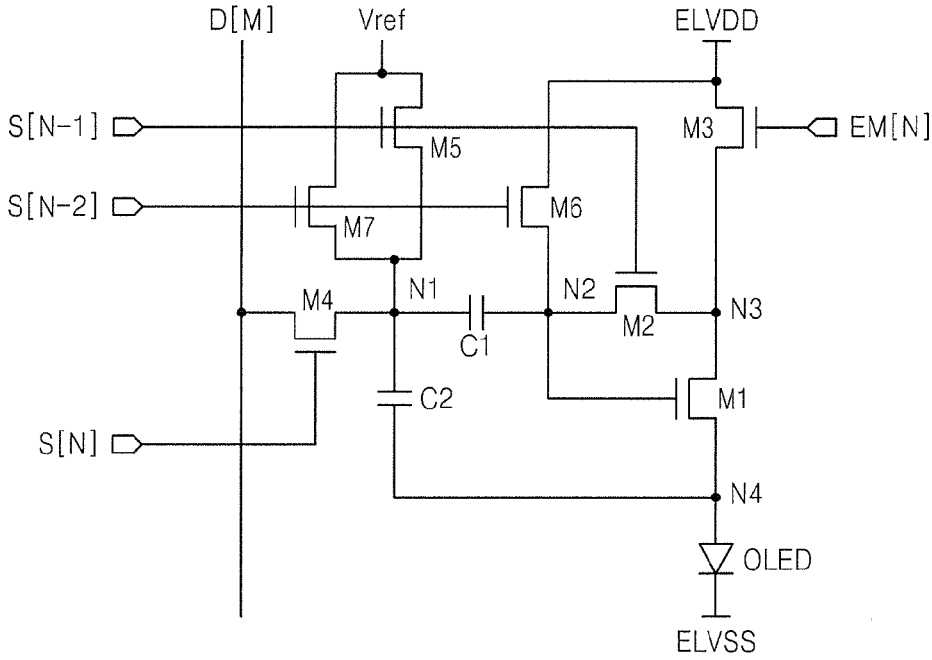
FIG. 8 is a circuit diagram of a pixel circuit illustrated in FIG. 3, according to another embodiment of the present invention.

FIG. 8 is a circuit diagram of a pixel circuit P illustrated in FIG. 3, according to another embodiment of the present invention.

The pixel circuit according to one embodiment depicted in FIG. 8 is different from the pixel circuit illustrated in FIG. 7 in that the pixel circuit of FIG. 8 further includes a seventh NMOS transistor M7 that is disposed in parallel with the fifth NMOS transistor M5.

With regard to the seventh NMOS transistor M7, a gate electrode is coupled to the first scan signal line S[N−2], a drain electrode is coupled to the reference power source Vref, and a source electrode is coupled to the first node N1. The seventh NMOS transistor M7 is turned on when the first scan signal, that is, a voltage signal having a high level, is transmitted through the first scan signal line S[N−2], and, when turned on, may transfer the reference voltage from the reference power source Vref to the first node N1, thereby initializing the first node N1 using the reference voltage from the reference power source Vref.

During an initialization period, in the pixel circuit illustrated in FIG. 7, the second node N2 is initialized using the first voltage from the first power source ELVDD transferred by the sixth NMOS transistor M6, and in the pixel circuit illustrated in FIG. 8, the second node N2 is initialized using the first voltage from the first power source ELVDD and the first node N1 is initialized using the reference voltage from the reference power source Vref transferred by the seventh NMOS transistor M7.

Driving operations, according to one embodiment of the present invention, of the pixel circuits illustrated in FIGS. 7 and 8 will now be described in detail with reference to the timing diagram shown in FIG. 9.

Figure 9:
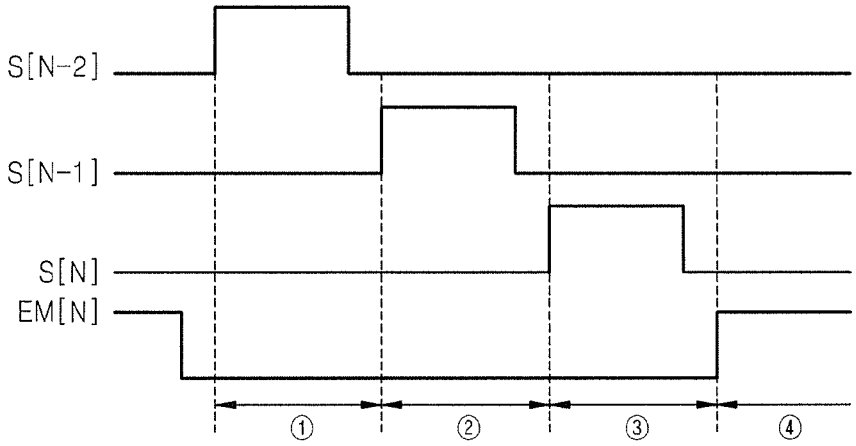
FIG. 9 is a timing diagram of driving signals (or waveforms) which may be used with the pixel circuits illustrated in FIGS. 7 and 8 according to one embodiment of the present invention.

Referring to FIG. 9, a first period is an initialization period during which the first scan signal of the first scan signal line S[N−2] has a high level, and a second period is a threshold voltage compensation period during which the threshold voltage Vto of the OLED and the threshold voltage Vth of the first NMOS transistor M1, that is, a driving transistor, are compensated for and during which the second scan signal of the second scan line S[N−1] has a high level. A third period is a data writing period during which the third scan signal of the third scan signal line S[N] has a high level. A fourth period is an emission period during which the emission control signal transmitted through the Nth emission control line EM[N] has a high level. That is, the timing diagram illustrated in FIG. 9 is different from the timing diagram illustrated in FIG. 6 in that the data writing and compensation for the threshold voltage Vto of the OLED and the threshold voltage Vth of the first NMOS transistor M1 are not concurrently performed. In other words, the threshold voltages are compensated for, and then data writing is performed.

Operations of the pixel circuits illustrated in FIGS. 7 and 8 are the same as those of the pixel circuits illustrated in FIGS. 4 and 5 except for the difference described above, and the current flowing through the OLEDs may be calculated using Equations 1 and 2. That is, the current $I_{OLED}$ flowing through either of the OLEDs is determined according to the reference voltage from the reference power source Vref and the data signal Vdata.

As described above, according to one or more of the above embodiments of the present invention, initialization of a pixel circuit may be performed separately from compensation and thus problems associated with a large organic electroluminescence display are reduced or solved, contrast ratio C/R is improved, cross-talk is reduced or overcome, the threshold voltage of a driving transistor is compensated for, and thus the uniformity of brightness of an image may be improved.

It should be understood that the exemplary embodiments described therein should be considered in a descriptive sense only and not for purposes of limitation. It is to be understood that the scope of the embodiments covers various modifications and equivalent arrangements included within the spirit and scope of the appended claims and their equivalents. Descriptions of features or aspects within each embodiment should typically be considered as available for other similar features or aspects in other embodiments.

What is claimed is:

1. A pixel circuit comprising:

an organic light emitting diode;

a fifth NMOS transistor comprising a gate electrode coupled to a third scan line, a first electrode coupled to a reference power source, and a second electrode coupled to a first node;

a first capacitor coupled between the first node and a second node;

a second capacitor coupled between the first node and an anode of the organic light emitting diode;

a fourth NMOS transistor comprising a gate electrode coupled to a second scan line, a first electrode coupled to a data line, and a second electrode coupled to the first node;

a sixth NMOS transistor comprising a gate electrode coupled to a first scan line, a first electrode coupled to a first power source, and a second electrode coupled to the second node;

a second NMOS transistor comprising a gate electrode coupled to the second scan line, a first electrode coupled to the second node, and a second electrode coupled to a third node;

a third NMOS transistor comprising a gate electrode coupled to an emission control line, a first electrode coupled to the first power source, and a second electrode coupled to the third node; and a first NMOS transistor for providing a driving current to the organic light emitting diode, the first NMOS transistor comprising a gate electrode coupled to the second node, a first electrode coupled to the third node, and a second electrode coupled to the anode of the organic light emitting diode.

2. The pixel circuit of claim 1, further comprising a seventh NMOS transistor comprising a gate electrode coupled to the first scan line, a first electrode coupled to the reference power source, and a second electrode coupled to the first node.

3. The pixel circuit of claim 2, wherein the seventh NMOS transistor is configured to transfer a reference voltage from the reference power source to the first node when a first scan signal is transmitted through the first scan line.

4. The pixel circuit of claim 2, wherein the sixth NMOS transistor is configured to transfer a first voltage from the first power source to the second node when a first scan signal is transmitted through the first scan line.

5. The pixel circuit of claim 1, wherein the sixth NMOS transistor is configured to transfer a first voltage from the first power source to the second node when a first scan signal is transmitted through the first scan line.

6. The pixel circuit of claim 5, wherein the fourth NMOS transistor is configured to transfer a data signal transmitted through the data line to the first node when a second scan signal is transmitted through the second scan line.

7. The pixel circuit of claim 6, wherein the fifth NMOS transistor is configured to transfer a reference voltage from the reference power source to the first node when a third scan signal is transmitted through the third scan line.

8. The pixel circuit of claim 7, wherein the pixel circuit is configured to receive the first scan signal, the second scan signal, and the third scan signal sequentially in the stated order.

9. The pixel circuit of claim 1, wherein the first electrode of the first NMOS transistor is a drain electrode, and the second electrode of the first NMOS transistor is a source electrode.

10. An organic light emitting display comprising:

a scan driver for supplying scan signals to scan lines and emission control signals to emission control lines;

a data driver for supplying data signals to data lines; and pixel circuits at crossing regions of the scan lines, the emission control lines, and the data lines, wherein at least one of the pixel circuits comprises:

an organic light emitting diode;

a fifth NMOS transistor comprising a gate electrode coupled to a third scan line of the scan lines and a second electrode coupled to a first node;

a first capacitor coupled between the first node and a second node;

a second capacitor coupled between the first node and an anode of the organic light emitting diode;

a fourth NMOS transistor comprising a gate electrode coupled to a second scan line of the scan lines, a first electrode coupled to a data line of the data lines, and a second electrode coupled to the first node;

a sixth NMOS transistor comprising a gate electrode coupled to a first scan line of the scan lines, a first electrode coupled to a first power source, and a second electrode coupled to the second node;

a second NMOS transistor comprising a gate electrode coupled to the second scan line, a first electrode coupled to the second node, and a second electrode coupled to a third node;

a third NMOS transistor comprising a gate electrode coupled to an emission control line of the emission control lines, a first electrode coupled to the first power source, and a second electrode coupled to the third node; and a first NMOS transistor for providing a driving current to the organic light emitting diode, the first NMOS transistor comprising a gate electrode coupled to the second node, a first electrode coupled to the third node, and a second electrode coupled to the anode of the organic light emitting diode.

11. The organic light emitting display of claim 10, wherein the at least one of the pixel circuits further comprises a seventh NMOS transistor comprising a gate electrode coupled to the first scan line, a first electrode coupled to a reference power source, and a second electrode coupled to the first node.

12. The organic light emitting display of claim 11, wherein the sixth NMOS transistor is configured to transfer a first voltage from the first power source to the second node when a first scan signal from among the scan signals is transmitted through the first scan line, the fourth NMOS transistor is configured to transfer a data signal from among the data signals transmitted through the data line to the first node when a second scan signal from among the scan signals is transmitted through the second scan line, the second NMOS transistor is configured to diode-connect the first NMOS transistor when the second scan signal is transmitted through the second scan line, and the fifth NMOS transistor is configured to transfer a reference voltage from a reference power source to the first node when a third scan signal is transmitted through the third scan line.

13. The organic light emitting display of claim 10, wherein the sixth NMOS transistor is configured to transfer a first voltage from the first power source to the second node when a first scan signal from among the scan signals is transmitted through the first scan line, the fourth NMOS transistor is configured to transfer a data signal from among the data signals transmitted through the data line to the first node when a second scan signal from among the scan signals is transmitted through the second scan line, the second NMOS transistor is configured to diode-connect the first NMOS transistor when the second scan signal is transmitted through the second scan line, and the fifth NMOS transistor is configured to transfer a reference voltage from a reference power source to the first node when a third scan signal from among the scan signals is transmitted through the third scan line.

14. The organic light emitting display of claim 13, wherein the scan driver is configured to sequentially supply the first scan signal, the second scan signal, and the third scan signal to the pixel circuits in the stated order.

* * * * *